US007757624B2

(12) United States Patent
Landolt

(10) Patent No.: US 7,757,624 B2
(45) Date of Patent: Jul. 20, 2010

(54) BOOKMARK

(76) Inventor: Kim Landolt, 13500 90th St., Kenosha, WI (US) 53142

( * ) Notice: Subject to any disclaimer, the term of this patent is extended or adjusted under 35 U.S.C. 154(b) by 0 days.

(21) Appl. No.: 12/428,990

(22) Filed: Apr. 23, 2009

(65) Prior Publication Data

US 2009/0205558 A1 Aug. 20, 2009

Related U.S. Application Data

(63) Continuation of application No. 11/736,031, filed on Apr. 17, 2007, now abandoned.

(60) Provisional application No. 60/797,009, filed on May 2, 2006.

(51) Int. Cl.
*B42D 9/00* (2006.01)
*B43K 29/00* (2006.01)

(52) U.S. Cl. ..... 116/238; 116/234; 401/195

(58) Field of Classification Search ..... 116/234, 116/235, 236, 237, 238, 239, 240; 281/42, 281/45; D19/34, 54, 55, 56, 57, 58; 401/195, 401/52

See application file for complete search history.

(56) References Cited

U.S. PATENT DOCUMENTS

| | | | |
|---|---|---|---|
| 27,266 | A | 2/1860 | Bond |
| 155,196 | A | 9/1874 | McNair |
| 229,626 | A | 7/1880 | McCalmont |
| 255,545 | A | 3/1882 | Stedwell |
| D25,703 | S | 6/1896 | Rothert |
| 746,847 | A | 12/1903 | Klopsch |
| 797,386 | A | 8/1905 | Van Buren |
| 901,225 | A | 10/1908 | Brockett et al. |
| 935,025 | A | 10/1909 | Smoot |
| 1,385,991 | A | 8/1921 | French |
| 1,438,299 | A | 12/1922 | Conter |
| 1,546,228 | A | 7/1925 | Gray |
| 1,646,291 | A | 10/1927 | Hornacek |
| 1,898,429 | A | 2/1933 | Domenego |

(Continued)

FOREIGN PATENT DOCUMENTS

CN 201053663 Y * 4/2008

(Continued)

OTHER PUBLICATIONS

Mary Carter, "How to Make a Beaded Wire Bookmark", Dec. 6, 2006, printed from Associated Content's website on Jan. 16, 2008.

*Primary Examiner*—R. A. Smith
(74) *Attorney, Agent, or Firm*—Jansson Shupe & Munger Ltd.

(57) ABSTRACT

A bookmark that has a wire-like elongate member which forms a between-page portion, a top portion and a spine-adjacent portion. The between-page portion is a uniplanar bending of the wire-like elongate member which includes different subportions. The subportions extend in different directions and include at least one subportion that extends along a line that is transverse to the spine-adjacent portion. The spine-adjacent portion is oriented with respect to the between-page portion such that the spine-adjacent portion extends along the spine of a book. The top portion connects the between-page portion and spine-adjacent portion and can be positioned over a top edge of a book. The wire-like elongate member is adapted to hold various items.

18 Claims, 13 Drawing Sheets

U.S. PATENT DOCUMENTS

| | | | | | |
|---|---|---|---|---|---|
| 2,282,939 | A | | 5/1942 | Clawson | |
| 2,300,216 | A | | 10/1942 | Grodsky et al. | |
| 2,436,609 | A | | 2/1948 | Safier | |
| 2,449,211 | A | | 9/1948 | Forsyth | |
| 2,576,783 | A | | 11/1951 | Dewey | |
| 2,674,972 | A | | 4/1954 | Luther | |
| 2,699,748 | A | | 1/1955 | Crawford | |
| 2,716,390 | A | | 8/1955 | Goins | |
| 2,780,481 | A | | 2/1957 | Green | |
| 2,798,453 | A | | 7/1957 | Jones et al. | |
| 3,036,547 | A | | 5/1962 | Groll | |
| 3,071,938 | A | * | 1/1963 | Davidson | 63/13 |
| 3,095,624 | A | | 7/1963 | Croisant | |
| 3,143,998 | A | | 8/1964 | Madden | |
| 3,513,806 | A | | 5/1970 | Ferrick | |
| 4,072,407 | A | | 2/1978 | Zeisky | |
| 4,235,457 | A | | 11/1980 | Brewer | |
| D271,888 | S | | 12/1983 | Dolas | |
| 4,436,053 | A | | 3/1984 | Zeisky | |
| 4,869,196 | A | | 9/1989 | Northcutt | |
| 4,898,115 | A | | 2/1990 | Bowlay-Williams | |
| 4,932,351 | A | | 6/1990 | Capamaggio | |
| 4,932,680 | A | | 6/1990 | Rivera | |
| 4,984,529 | A | | 1/1991 | Dickson | |
| 4,986,683 | A | * | 1/1991 | Whitright | 401/195 |
| 5,016,559 | A | | 5/1991 | Larson et al. | |
| 5,022,342 | A | | 6/1991 | Davis | |
| 5,072,686 | A | | 12/1991 | Falco | |
| 5,095,846 | A | | 3/1992 | Knight | |
| 5,103,758 | A | | 4/1992 | Clark | |
| 5,112,268 | A | | 5/1992 | Klaus | |
| 5,152,553 | A | | 10/1992 | Domingo | |
| 5,165,722 | A | | 11/1992 | Wong | |
| 5,286,060 | A | | 2/1994 | Rivera | |
| 5,375,885 | A | | 12/1994 | Abercrombie | |
| 5,377,612 | A | | 1/1995 | Catalano et al. | |
| 5,382,053 | A | | 1/1995 | Tanaka | |
| 5,408,950 | A | | 4/1995 | Porto | |
| 5,443,029 | A | | 8/1995 | Garnet | |
| 5,458,081 | A | | 10/1995 | Reichert | |
| 5,462,006 | A | | 10/1995 | Thiruppathi | |
| 5,501,171 | A | | 3/1996 | Leake | |
| 5,515,809 | A | | 5/1996 | Weinberg | |
| 5,533,363 | A | * | 7/1996 | Callisto | 63/14.1 |
| 5,826,997 | A | * | 10/1998 | Coleman et al. | 401/52 |
| 6,006,693 | A | | 12/1999 | Burkett | |
| 6,045,281 | A | * | 4/2000 | Bunn et al. | 401/195 |
| 6,089,609 | A | | 7/2000 | Denley | |
| 6,109,204 | A | | 8/2000 | Hoey et al. | |
| D434,798 | S | * | 12/2000 | Platts et al. | D19/42 |
| 6,332,727 | B1 | * | 12/2001 | Hsu | 401/195 |
| 6,390,015 | B1 | | 5/2002 | Germano | |
| 6,446,803 | B1 | | 9/2002 | McKinney | |
| 6,481,367 | B2 | | 11/2002 | McClosky | |
| D484,535 | S | * | 12/2003 | Fang | D19/36 |
| 6,722,309 | B1 | | 4/2004 | Ben-Dor et al. | |
| 6,743,072 | B2 | * | 6/2004 | Nelson et al. | 446/490 |
| 6,854,417 | B2 | | 2/2005 | Stephens | |
| 6,902,196 | B1 | | 6/2005 | Olson | |
| 6,971,812 | B1 | * | 12/2005 | Chen | 401/195 |
| 2004/0093781 | A1 | * | 5/2004 | Sievers | 40/745 |
| 2005/0057536 | A1 | * | 3/2005 | Killion | 345/179 |
| 2007/0048067 | A1 | * | 3/2007 | Gerules et al. | 401/195 |

FOREIGN PATENT DOCUMENTS

| | | | | |
|---|---|---|---|---|
| DE | 20208492 | U1 | * | 12/2002 |
| FR | 2763024 | A1 | | 11/1998 |
| GB | 2406546 | A | * | 4/2005 |
| JP | 06293196 | A | * | 10/1994 |
| WO | WO 8905236 | A1 | * | 6/1989 |

* cited by examiner

BOOKMARK

RELATED APPLICATION

This present application is a continuation of U.S. patent application Ser. No. 11/736,031, filed Apr. 17, 2007, which claims the benefit of U.S. Provisional Application No. 60/797,009, filed on May 2, 2006, the contents of which are incorporated by reference herein in their entirety.

FIELD OF THE INVENTION

This invention is related generally to bookmarks and more particularly to multi-purpose bookmarks which serve more than one functional purpose.

BACKGROUND OF THE INVENTION

There have been a number of prior devices in the field of bookmarks which have departed from the typical sheet-like member style of bookmark. Examples of such inventions in the prior art typically consist of a bookmark which simply marks a certain page in a book or a bookmark which may have a light attached to it. Examples of these prior art bookmarks are disclosed in the following United States patents: U.S. Pat. No. 3,513,806 (Ferrick), U.S. Pat. No. 5,286,060 (Rivera) and U.S. Pat. No. 5,095,846 (Knight).

These bookmarks of the prior art have, however, a number of problems and shortcomings. In many cases such bookmarks are bulky and difficult to fit between the pages of a book. Certain other prior art bookmarks have what is essentially only a single linear strand for placement between pages, and this can create problems of instability. Such instability means that the portion of the bookmark device which is not between the pages can have a tendency to rotate about the linear portion that is between the pages, not to mention the fact that users are accustomed to generally fiat bookmarks for placement between pages.

There is also need for bookmarks that have special features such as being personalized to the particular style of an individual. The prior art does not contain a bookmark that can be personalized to a particular style while also being non-bulky. stable in position and easy to use. A bookmark of this sort would be desirable.

OBJECTS OF THE INVENTION

It is an object of this invention to provide a bookmark that has multiple purposes and overcomes some of the problems and shortcomings associated with the prior art.

Another object is to provide a bookmark which is non-bulky, planar and also stable.

Still another object is to provide a bookmark which can be personalized to the specific style of the user while being non-bulky, planar and stable.

These and other objects of the invention will be apparent from the following descriptions and from the drawings.

SUMMARY OF THE INVENTION

This invention meets these needs and overcomes other problems and shortcomings in the prior art with a special bookmark that is non-bulky, light-weight, inexpensive to construct and stable in place. The invention is a bookmark which serves numerous functions.

The bookmark of this invention includes a wire-like elongate member which consists of a between-page portion, a top portion and a spine-adjacent portion. The between-page portion includes a uniplanar bending of the wire-like elongate member. The between-page portion has different subportions which extend in different directions. At least one of the subportions extends along a line that is transverse to the spine-adjacent portion.

In certain desired embodiments the uniplanar between-page portion includes a plurality of subportions which extend along lines that intersect the line of the spine-adjacent portion. In highly preferred embodiments, the spine-adjacent portion is oriented with respect to the between-page portion such that the spine-adjacent portion is extended along a book spine. Preferably, the top portion connects the between-page portion and spine-adjacent portion and is adapted to be positioned over the top edge of a book spine.

Most preferred is where the wire-like elongate member is a single wire constructed of metal. Preferably, the spine-adjacent portion is formed in a non-linear shape. In certain embodiments, the spine-adjacent portion is in the form of a helix or spiral. Highly desirable is where the spiral shape is adapted such that an elongate writing implement is insertable into the spiral.

In highly preferred embodiments, the wire-like elongate member has at least one item threaded thereon and movable therealong. In certain embodiments, the wire-like elongate member has a plurality of items threaded thereon and moveable therealong. Preferably, at least one of the items is selected from the group consisting of a charm, a bead, a gem, a magnet, a wheel, a gear, a bell, a light, a ring, a chain, a button, a clip, a stone, a coin, a time keeper, a line indicator, a ribbon and an identification tag.

In certain preferred embodiments, the between-page portion has a clear pocket and/or a notepad attached to it. The wire-like elongate member preferably may also have a flexible elongate member positioned on it for selected between-page placement.

This invention also includes a pencil-topper which is a wire-like elongate member which has a spiral portion that is adapted to receive an elongate writing implement and an end portion which is a uniplanar bending of the wire-like elongate member. The end portion has different subportions which extend in different directions.

In certain preferred embodiments, the line defining axis of the spiral portion is in the plane of the end portion. Most preferred is where the spiral portion has at least one item threaded on it and movable along the spiral portion. In certain desired embodiments there are a plurality of items threaded onto the spiral portion and movable along. Preferably, at least one of the items is selected from the group consisting of a charm, a bead, a gem, a magnet, a wheel, a gear, a bell, a light, a ring, a chain, a button, a clip, a stone, a coin, a lime keeper, a line indicator, a ribbon and an identification tag.

BRIEF DESCRIPTION OF THE DRAWINGS

The drawings illustrate preferred embodiments including the above-noted characteristics and features. The inventive products will be readily understood from the descriptions and drawings. In the drawings.

DETAILED DESCRIPTION OF PREFERRED EMBODIMENTS

Figure 1:
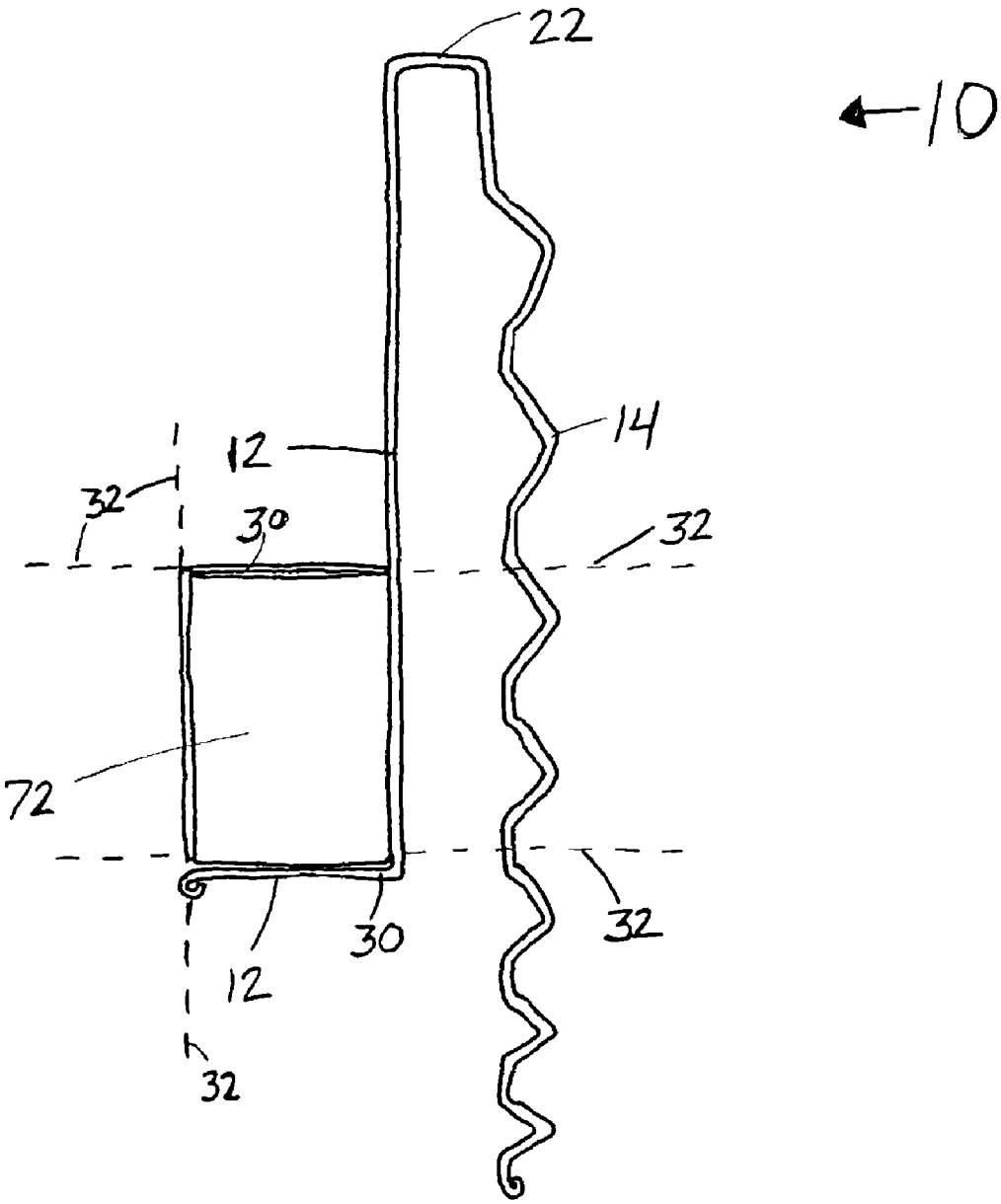
FIG. 1 is a front view of the bookmark, the between-page portion has a clear pocket attached thereto and the line defining axis is also present, the spine-adjacent portion is in a triangle-spiral shape.

FIGS. 1-11 illustrate a bookmark 10 that serves to hold a page 20 in a book 16 and also to hold various items 28. As shown in FIGS. 1-11, the bookmark 10 is comprised of a wire-like elongate member 24 that is made of metal. The wire-like elongate member 24 can be made from a single wire or multiple wires connected together.

As illustrated in FIGS. 1-2, 4, 6-7 and 9-11, the wire-like elongate member 24 forms a between-page portion 12, a top portion 22 and a spine-adjacent portion 14. The between-page portion 12 is a uniplanar bending of the wire-like elongate member 24 with different subportions 30 thereof which extend in different directions and include at least one subportion 30 which extends along a line defining axis 32 that is transverse to the spine-adjacent portion 14 as shown in FIG. 1. The between-page portion 12 is substantially flat so that it can be easily placed between the pages 20 of a book 16 as seen in FIGS. 1-2, 4, 6-7 and 9-11. The between-page portion can be formed into various shapes as shown in FIGS. 1-2, 6 and 9-11.

Figure 2:
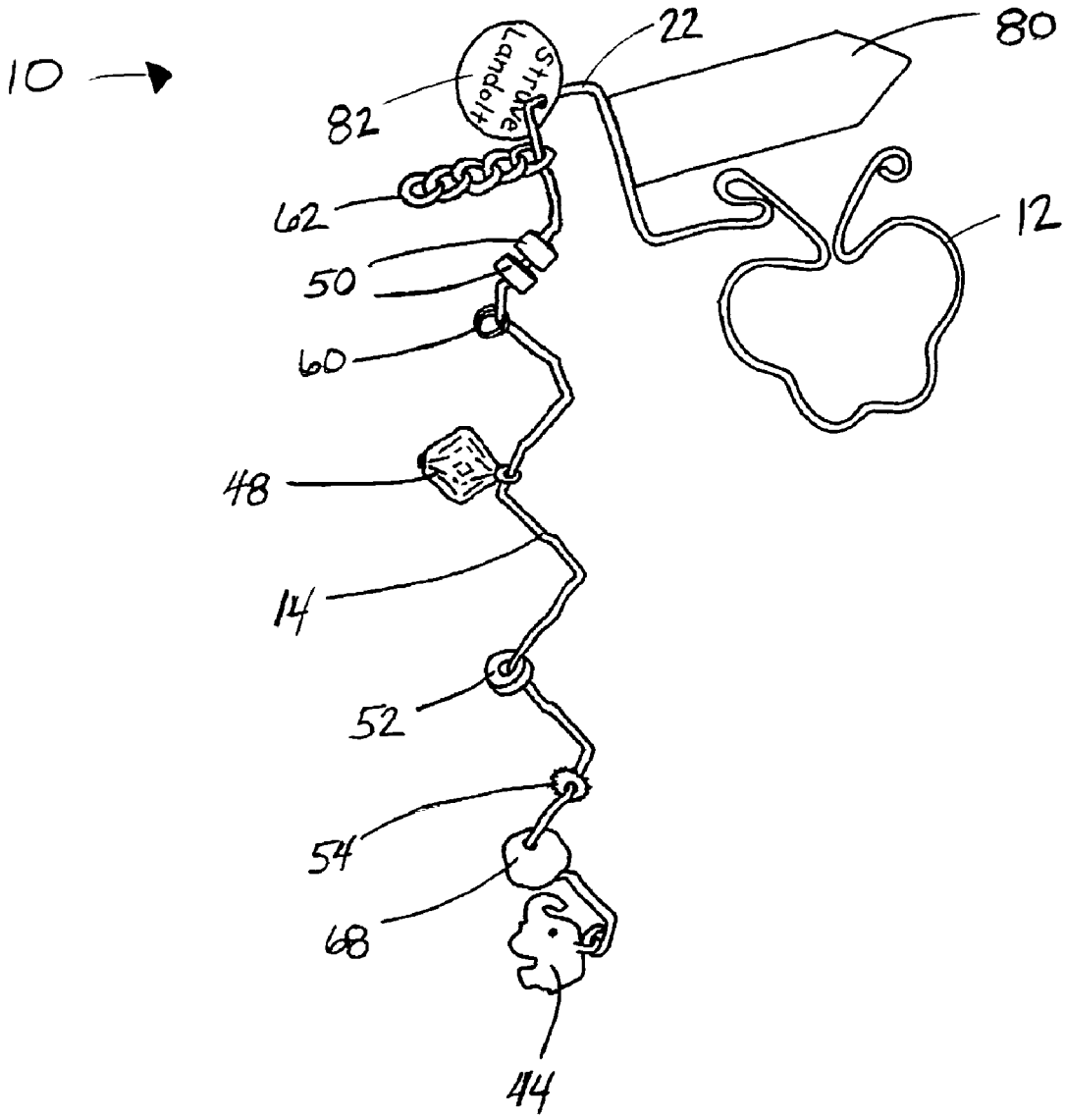
FIG. 2 is a front view of another embodiment of the bookmark with the spine-adjacent portion containing a variety of items.
Figure 3:
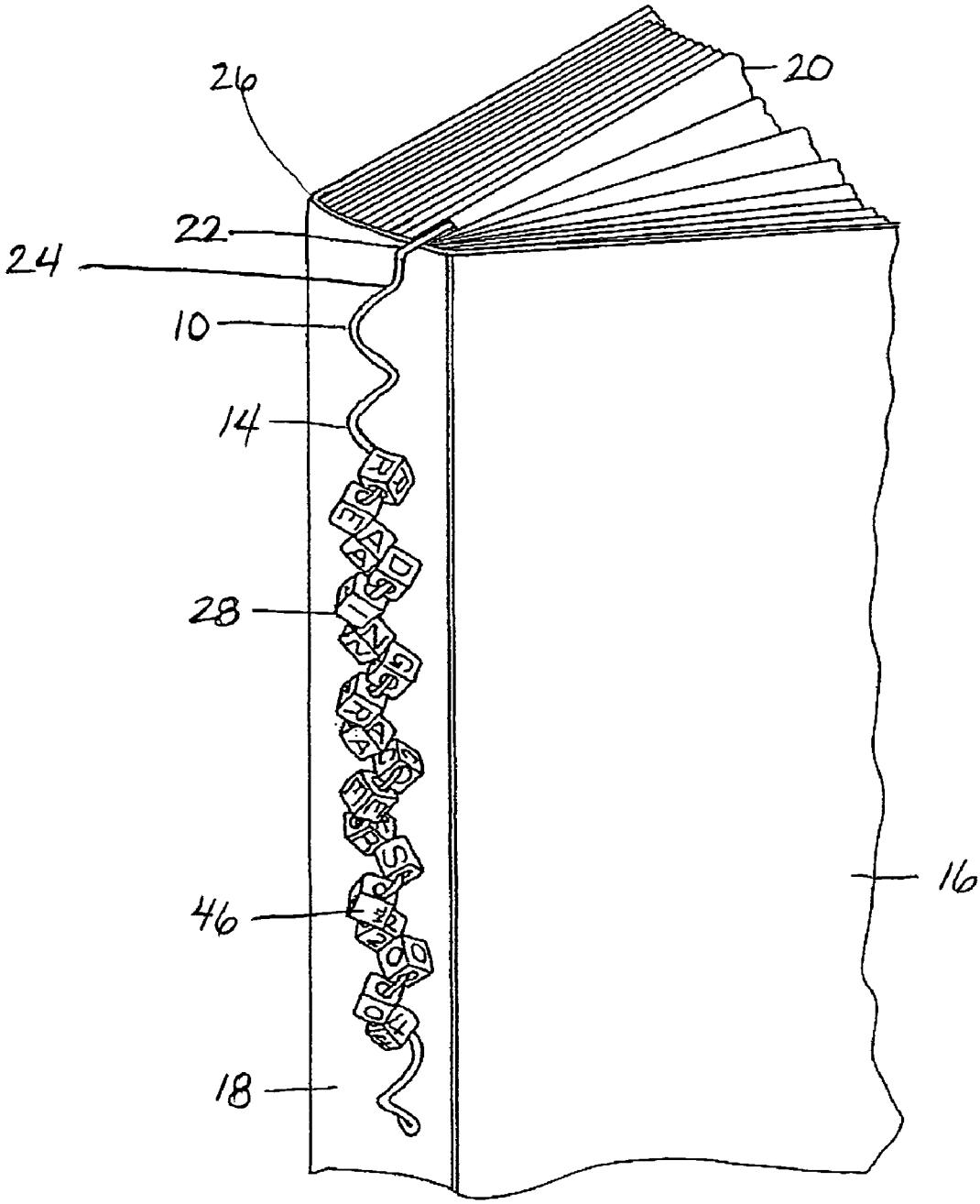
FIG. 3 is a perspective view of yet another embodiment of the bookmark with the between-page portion of the bookmark between the pages of a book and the spine-adjacent portion extending along the book spine.
Figure 4:
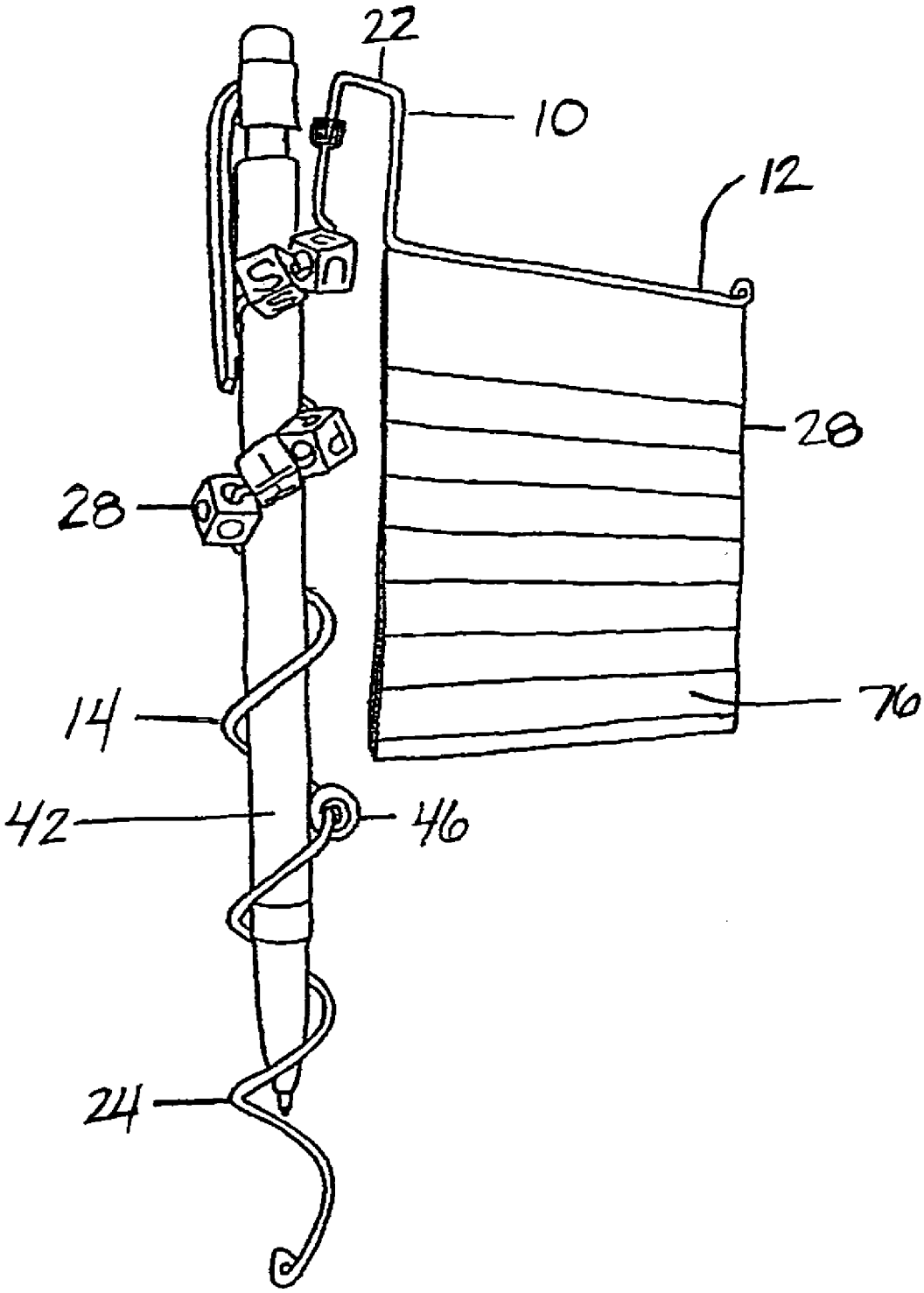
FIG. 4 is a perspective view of another embodiment of the bookmark holding a pencil and notepad.
Figure 5:
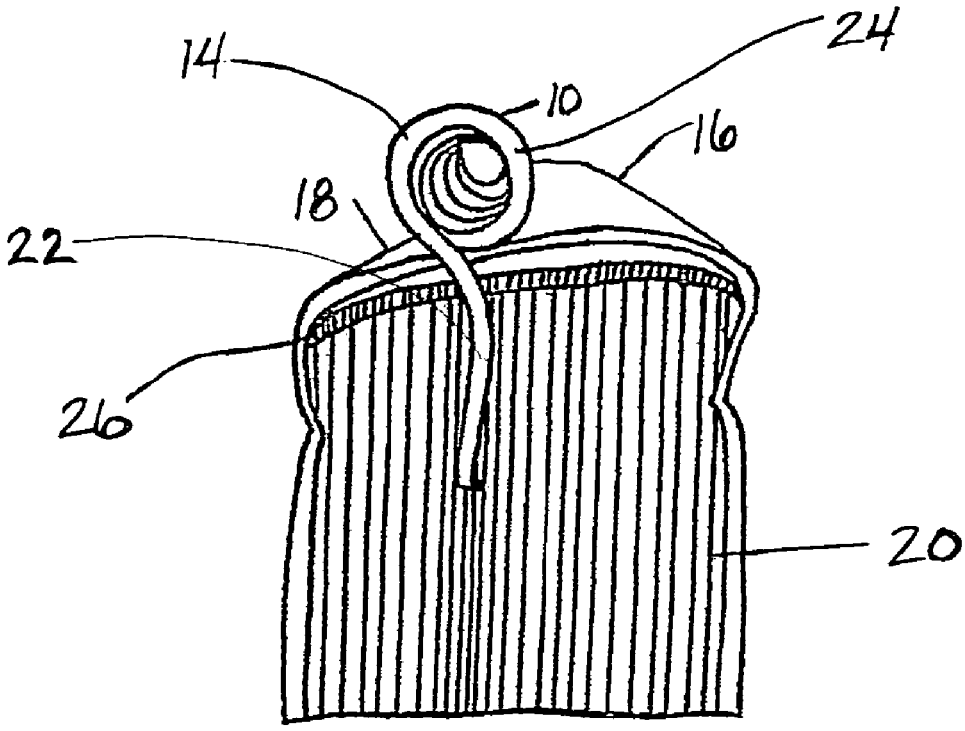
FIG. 5 is top view of the bookmark of FIG. 3 positioned between the pages of a book.

As shown in FIGS. 1-2, 4, 6 and 9-11 the lop portion 22 connects the between-page portion 12 and the spine-adjacent portion 14. As shown in FIGS. 3 and 5, the top portion 22 is adapted so that it can be positioned over the top edge 26 of a spine 18 of a book 16.

Figure 6:
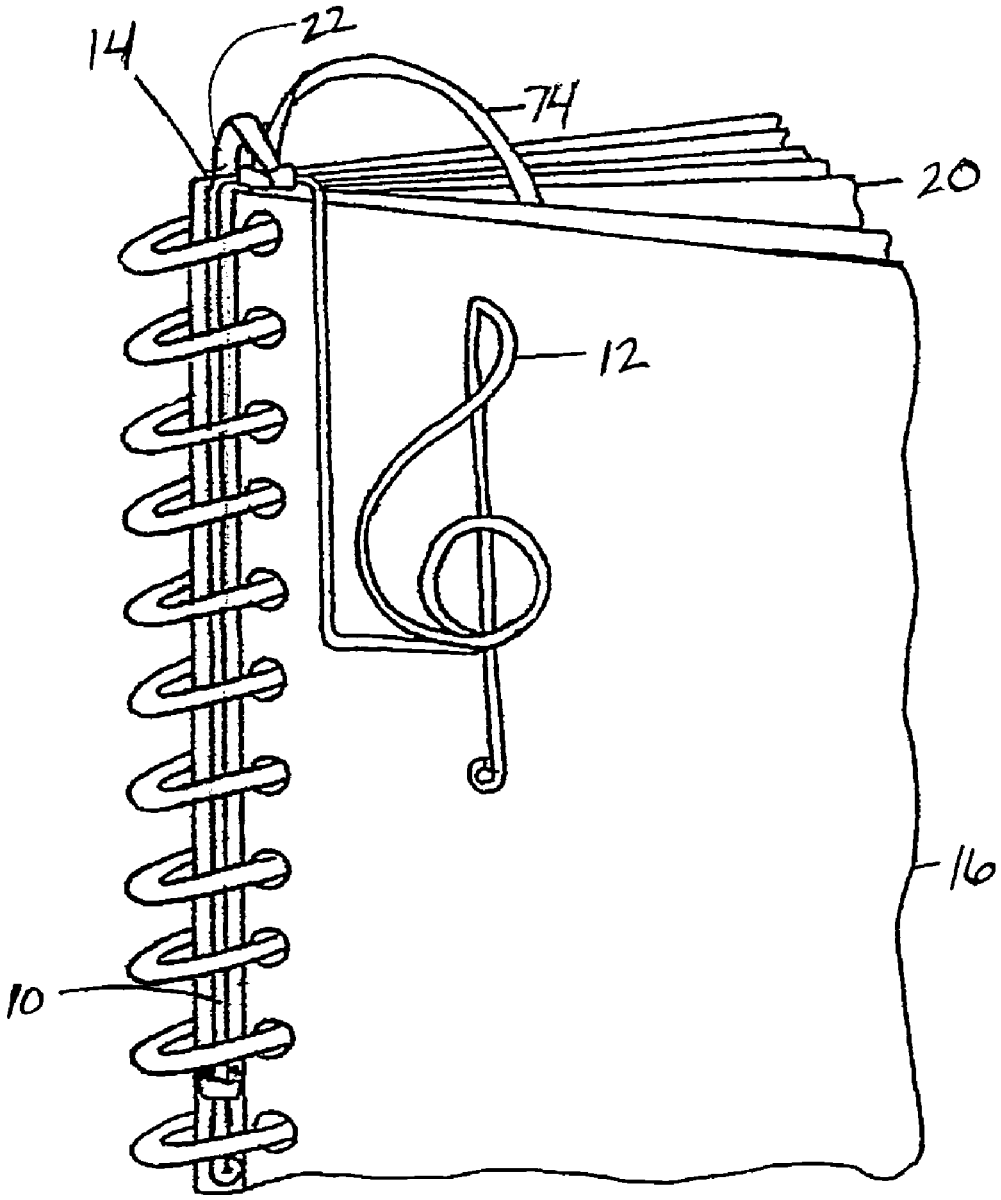
FIG. 6 is a front view of another embodiment of the bookmark with a ribbon positioned between the pages of a book.
Figure 7:
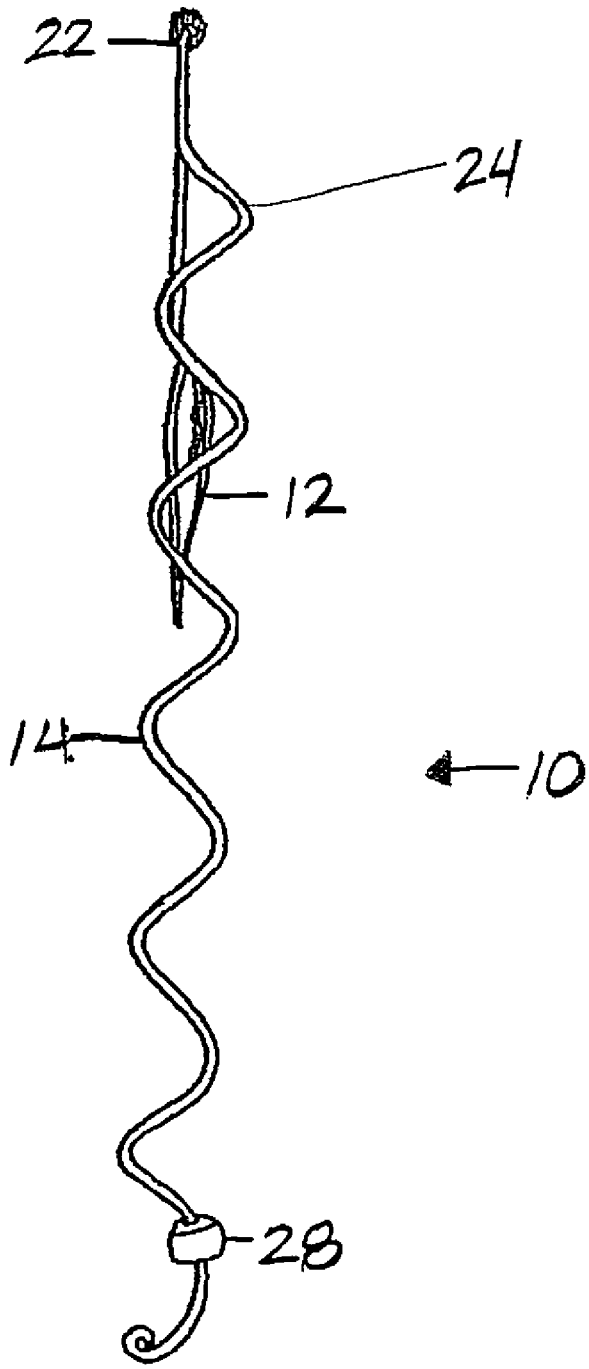
FIG. 7 is side view of yet another embodiment of the bookmark.

As illustrated in FIGS. 3 and 6, the spine-adjacent portion 14 is oriented with respect to the between-page portion 12 such that the spine-adjacent portion 14 extends along the spine 18 of a book 16. As shown in FIGS. 3-5 and 7-11. the spine-adjacent portion 14 is preferably formed in a non-linear shape. The spine-adjacent portion can be formed into a spiral as shown in FIGS. 3-5, 7 and 9, so that an elongate writing implement 42, such as a pen or pencil, can be inserted into the spine-adjacent portion 14 and held in place until it is needed as shown in FIG. 4.

Figure 8:
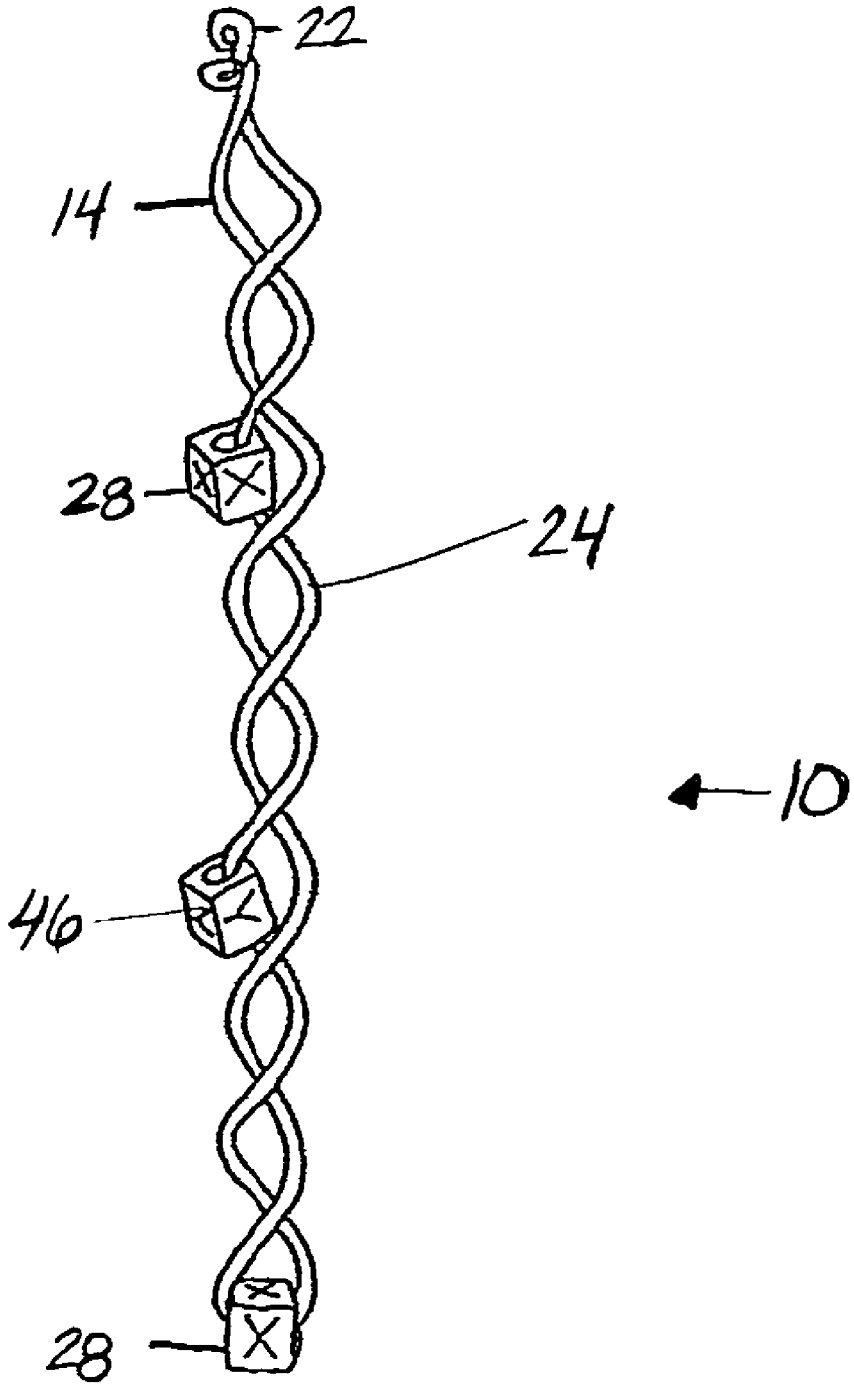
FIG. 8 is a front view of the spine-adjacent and top portions of another embodiment of the invention in the helical configuration.
Figure 10:
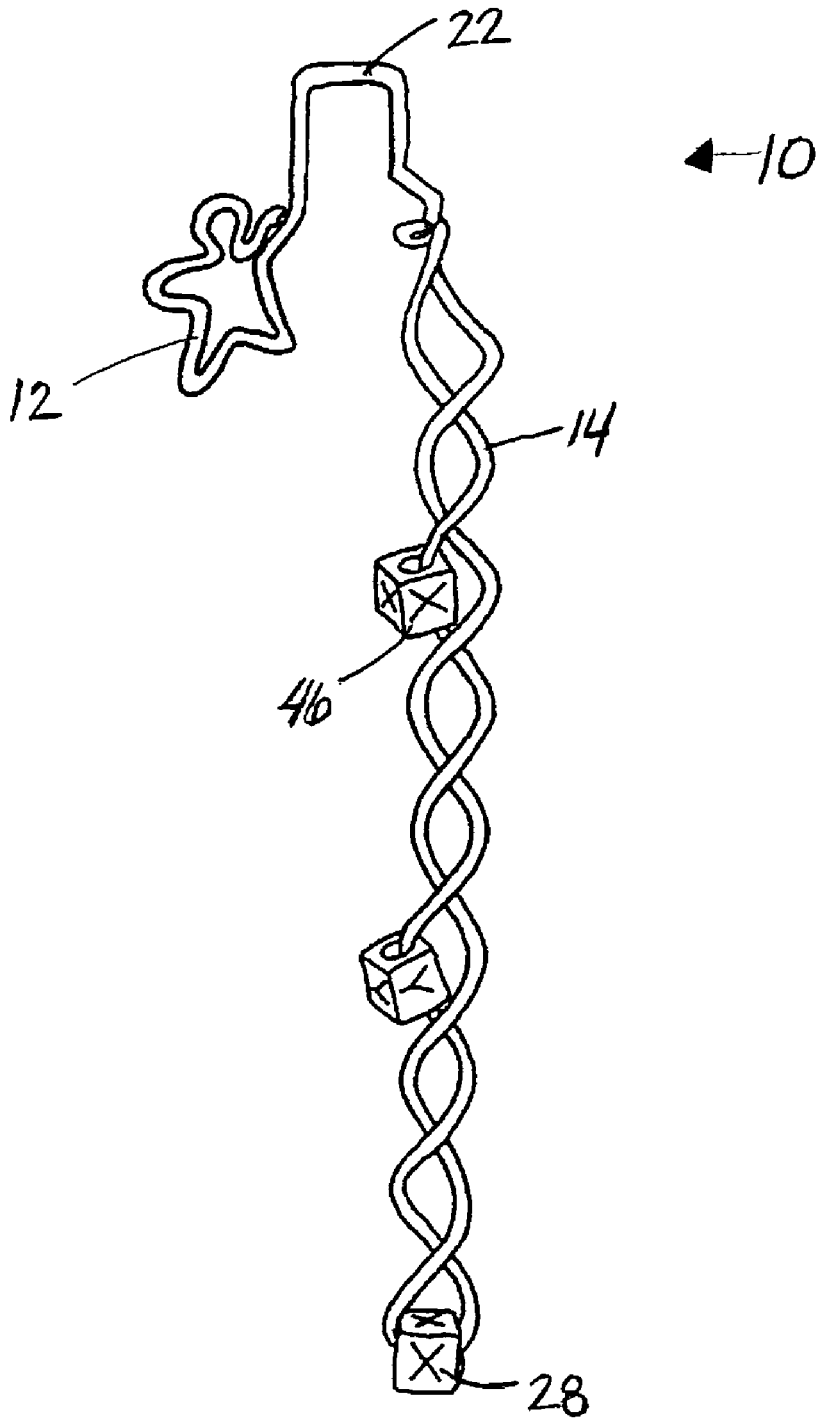
FIG. 10 is a front view of the bookmark of FIG. 8 with the spine-adjacent portion in the helical configuration.
Figure 11:
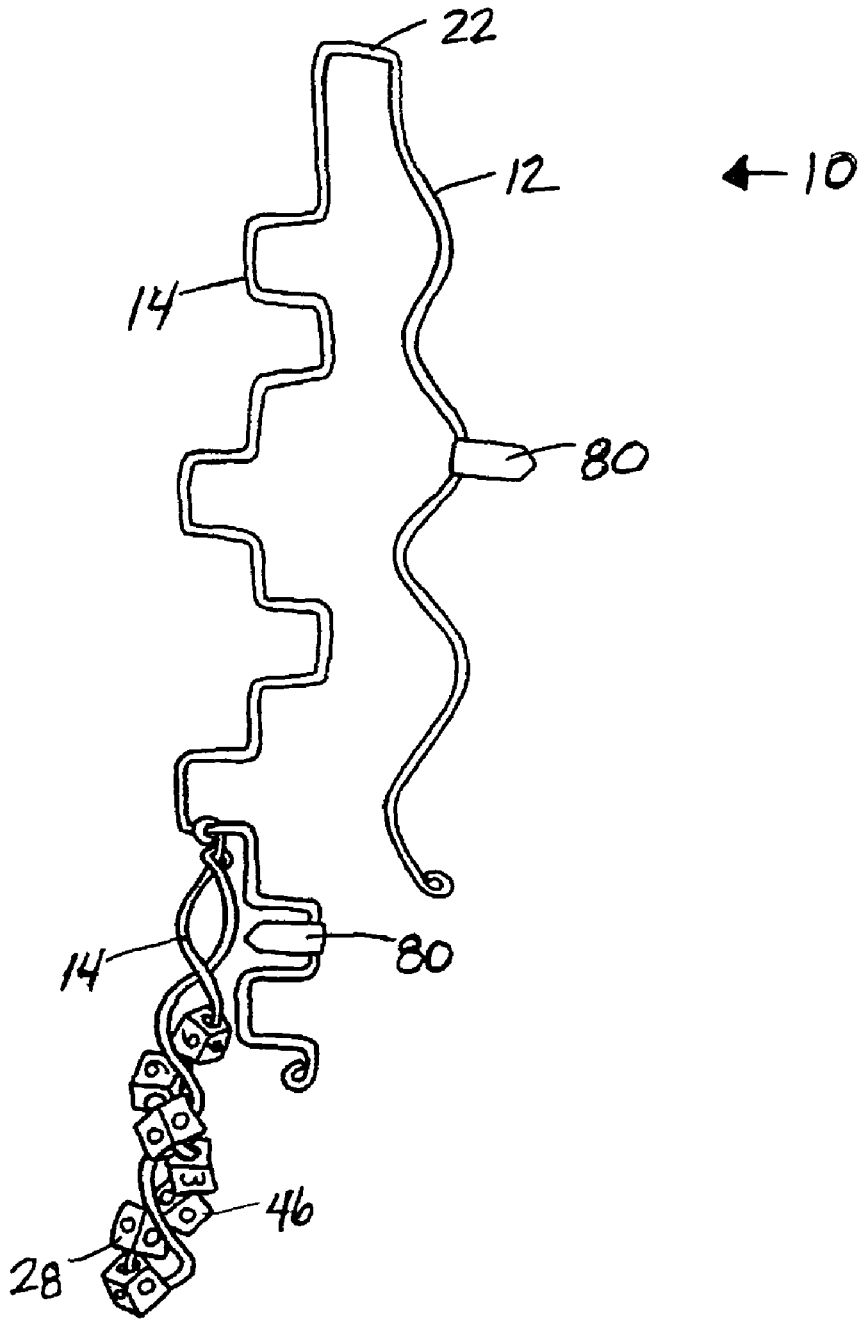
FIG. 11 is a front view of the bookmark in another embodiment with the spine-adjacent portion containing a variety of items.

The spine-adjacent portion 14 can be formed into a double helix as illustrated in FIGS. 8 and 10. The spine-adjacent portion 14 can also be formed into various other non-linear shapes as exhibited in FIGS. 1-2, 8 and 10-11. FIG. 6 shows that the spine-adjacent portion 14 can also be linear.

As shown in FIGS. 2-4 and 7-11, the between-page portion 12, top portion 22 and/or spine-adjacent portion 14 can have a single item 28 or multiple items 28 attached to them, the items can be stationary or moveable. Items 28 attached to the spine-adjacent portion 14 can be stationary or moveable along the spine-adjacent portion 14 as illustrated in FIGS. 2-4 and 7-11.

Figure 9:
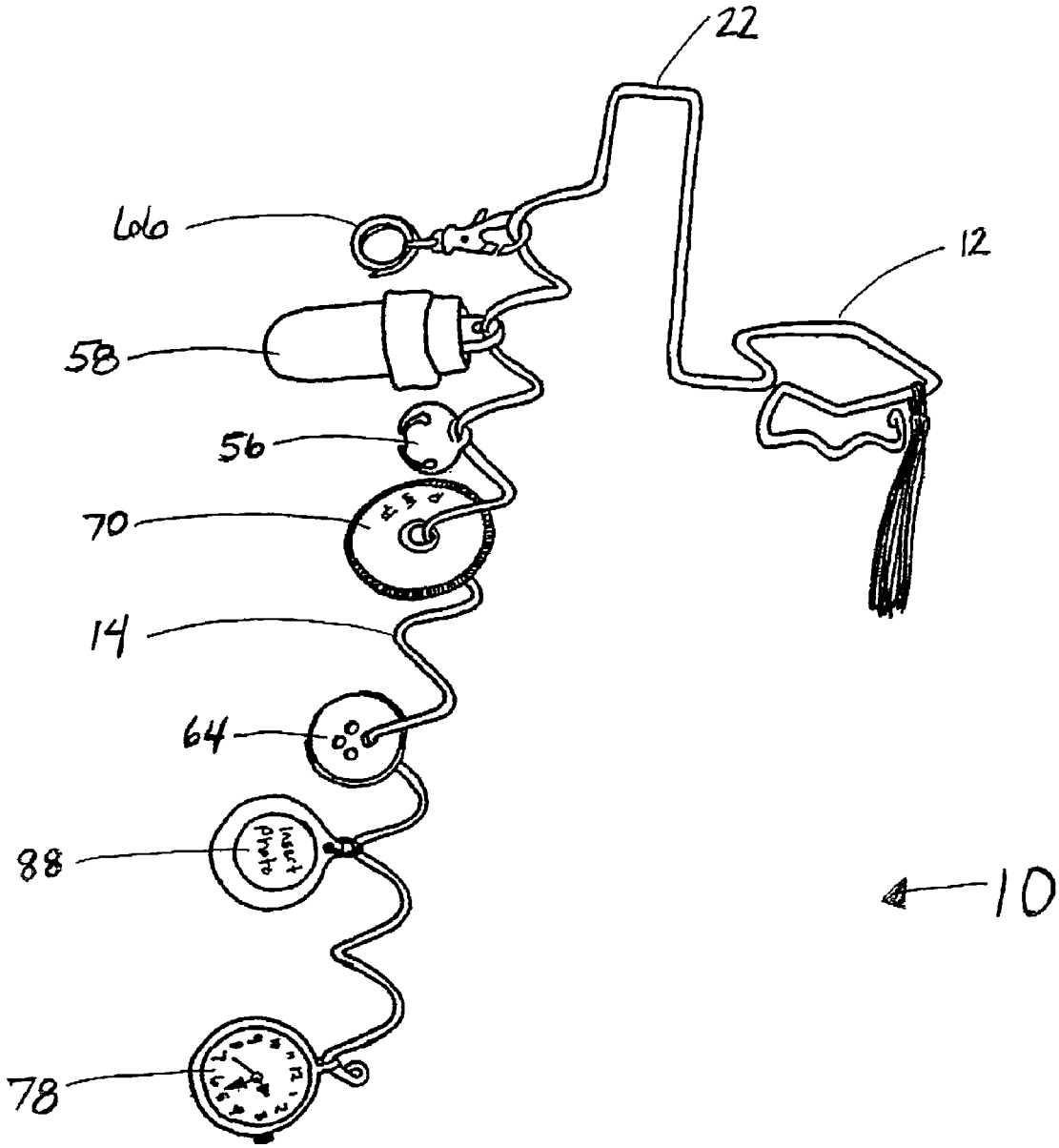
FIG. 9 is a front view of another embodiment of the bookmark with the spine-adjacent portion containing a variety of items.

As shown in FIG. 3, the item 28 can be a bead 46. As shown in FIG. 6, the item 28 can be a flexible elongate member such as a ribbon 74. FIGS. 2 and 9 illustrate that the items 28 which can be attached to the between-page portion 12, top portion 22 and/or spine-adjacent portion 14 also include a clip 66, a light 58, a bell 56, a coin 70, a button 64, a photo holder 88, a time keeper 78, a line indicator 80, an identification tag 82, a chain 62, a magnet 50, a ring 60, a gem 48, a wheel 52, a gear 54, a stone 68 and a charm 44. FIG. 4 illustrates that a notepad 76 can be attached to the between-page portion 12. FIG. 1 shows that a clear pocket 72 can be attached to the between-page portion 12. The clear pocket 72 can consist of more than one pocket page in various sizes and shapes and it is adapted to hold a multitude of items.

Figure 12:
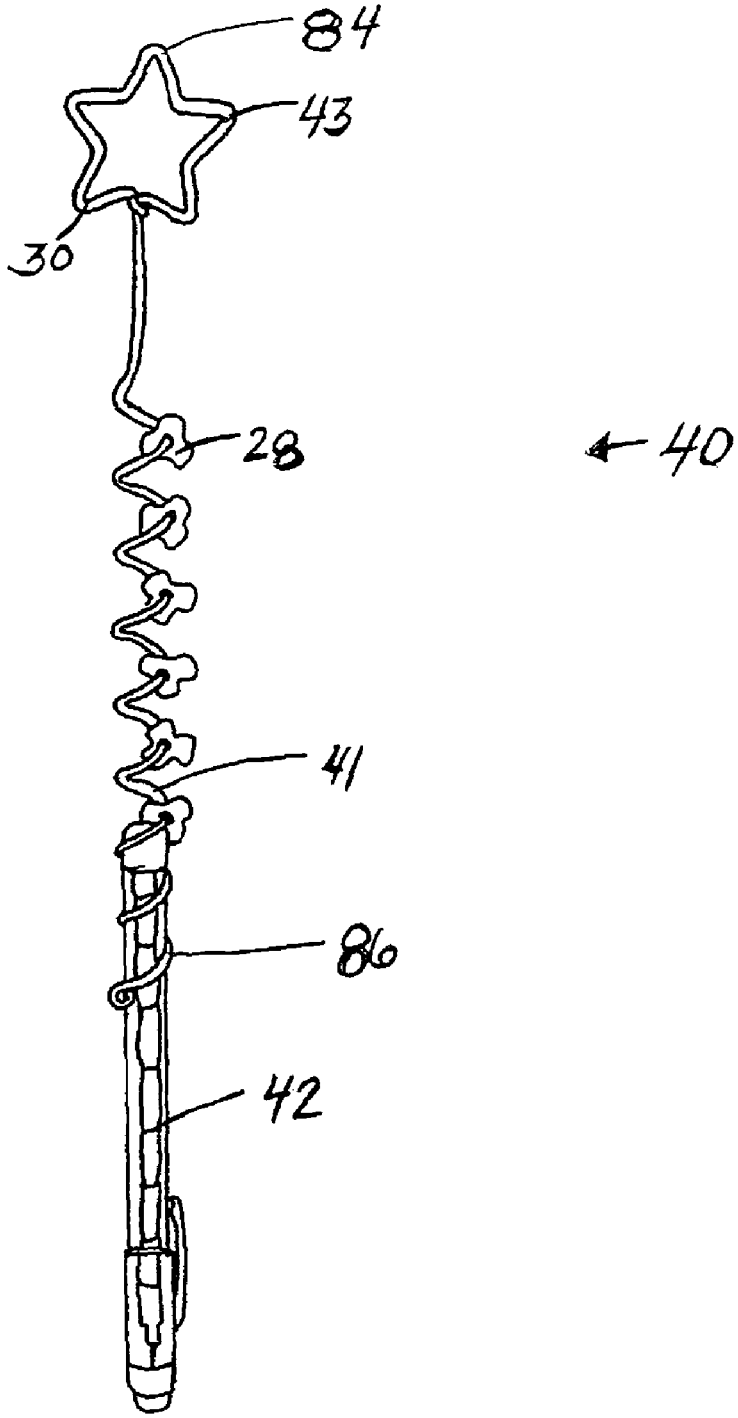
FIG. 12 is a front view of another embodiment illustrating the pencil topper, the spiral portion contains items and is holding an elongate writing implement.
Figure 13:
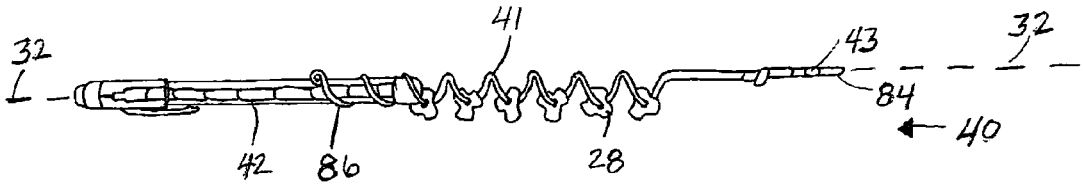
FIG. 13 is a side view of the pencil topper of FIG. 12, the spiral portion contains items and is holding an elongate writing implement.

FIGS. 12 and 13 illustrate a pencil topper 40 which has a wire-like elongate member 24 that forms a spiral portion 41 and an end portion 43. As illustrated in FIG. 12, a line defining axis 32 of the spiral portion 41 is in the same plane as the end portion 43. The end portion 43 consists of a uniplanar bending of the wire-like elongate member 24 with different subportions 30 extending in different directions as shown in FIG. 12.

The pencil topper 40 has a top end 84 and a bottom end 86. The spiral portion 41 is adapted to receive an elongate writing implement 42 in the bottom end 86 of the pencil topper 40 as illustrated in FIGS. 12 and 13. As seen in FIGS. 12 and 13, one item 28 or various items 28 can be attached to the spiral portion 41. The items 28 are threaded onto the spiral portion 41 and are moveable along or stationary the spiral portion 41.

A wide variety of materials are available for the various parts discussed and illustrated herein. Although the invention has been shown and described in conjunction with specific embodiments thereof, it is to be understood that many alternatives, modifications and variations will be apparent to those skilled in the art. Accordingly, it is intended to embrace all such alternatives, modifications and variations that fall within the spirit and broad scope of the appended claims.

The invention claimed is:

1. A bookmark comprising a wire-like elongate member forming a between-page portion, a top portion and a spine-adjacent portion, the spine-adjacent portion being a single wire in a non-linear shape which is bent to be adapted such that an elongate writing implement is insertable therein in a direction from the top portion, the between-page portion being a uniplanar bending of the wire-like elongate member with different subportions thereof extending in different directions including at least one subportion extending along a line that is transverse to the spine-adjacent portion.

2. The bookmark of claim 1 wherein the uniplanar between-page portion includes a plurality of subportions extending along lines which intersect the line of the spine-adjacent portion.

3. The bookmark of claim 1 wherein the spine-adjacent portion is oriented with respect to the between-page portion such that the spine-adjacent portion is for extending along a book spine.

4. The bookmark of claim 1 wherein the top portion connects the between-page portion and spine-adjacent portion and is adapted to be positioned over the top edge of a book spine.

5. The bookmark of claim 1 wherein the wire-like elongate member is a single wire constructed of metal.

6. The bookmark of claim 1 wherein the spine-adjacent portion is in the form of a helix.

7. The bookmark of claim 1 wherein the wire-like elongate member has at least one item threaded thereon and movable therealong.

8. The bookmark of claim 7 wherein there arc a plurality of items.

9. The bookmark of claim 7 wherein the at least one item is selected from the group consisting of a charm, a bead, a gem, a magnet, a wheel, a gear, a bell, a light, a ring, a chain, a button, a clip, a stone, a coin, a time keeper, a line indicator, a ribbon and an identification tag.

10. The bookmark of claim 1 wherein the between-page portion has a clear pocket thereon.

11. The bookmark of claim 1 wherein the between-page portion has a notepad attached thereto.

12. The bookmark of claim 1 wherein the wire-like elongate member has a flexible elongate member thereon positioned for selected between-page placement.

13. The bookmark of claim 1 wherein the spine-adjacent portion is substantially spiral.

14. A pencil-topper comprising a wire-like elongate member forming a spiral portion that is adaptable to receive an elongate writing implement and an end portion which is a uniplanar bending of the wire-like elongate member with different subportions thereof extending in different directions.

15. The pencil-topper of claim 14 wherein a line defining axis of the spiral portion is in the plane of the end portion.

16. The pencil-topper of claim 14 wherein the spiral portion has at least one item threaded thereon and movable therealong.

17. The pencil-topper of claim 16 wherein there are a plurality of items.

18. The pencil-topper of claim 16 wherein at least one of the items is selected from the group consisting of a charm, a bead, a gem, a magnet, a wheel, a gear, a bell, a light, a ring, a chain, a button, a clip, a stone, a coin, a time keeper, a line indicator, a ribbon and an identification tag.

* * * * *